US008640661B2

(12) United States Patent
Kong et al.

(10) Patent No.: US 8,640,661 B2
(45) Date of Patent: Feb. 4, 2014

(54) CONTINUOUS VARIABLE VALVE TIMING APPARATUS

(75) Inventors: Jin Kook Kong, Suwon-si (KR); Soo Hyung Woo, Yongin-si (KR); Jin Soon Kim, Hwaseong-si (KR); Sang Won Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 471 days.

(21) Appl. No.: 12/958,040

(22) Filed: Dec. 1, 2010

(65) Prior Publication Data

US 2011/0308488 A1 Dec. 22, 2011

(30) Foreign Application Priority Data

Jun. 16, 2010 (KR) ..... 10-2010-0057205

(51) Int. Cl.
*F01L 1/34* (2006.01)

(52) U.S. Cl.
USPC ..... 123/90.17; 123/90.15; 74/425; 464/160; 475/7; 475/228; 475/230; 475/304; 475/333; 475/336; 475/343

(58) Field of Classification Search
USPC ..... 123/90.19, 90.17, 90.15; 74/425; 475/336, 343, 331, 7, 228, 230, 304, 475/333; 464/160
See application file for complete search history.

(56) References Cited

U.S. PATENT DOCUMENTS

| | | | | |
|---|---|---|---|---|
| 1,996,365 | A * | 4/1935 | Clinedinst | 475/7 |
| 2,245,075 | A * | 6/1941 | Mingle | 74/395 |
| 2,827,799 | A * | 3/1958 | Pullins | 74/425 |
| 3,364,789 | A * | 1/1968 | Whitfield | 475/7 |
| 5,156,119 | A * | 10/1992 | Suga | 123/90.17 |
| 6,622,677 | B2 * | 9/2003 | Simpson et al. | 123/90.15 |
| 7,540,821 | B2 * | 6/2009 | Gleasman et al. | 475/227 |
| 2002/0100446 | A1 * | 8/2002 | Watanabe | 123/90.17 |
| 2008/0087241 | A1 * | 4/2008 | Taye et al. | 123/90.17 |
| 2009/0031974 | A1 * | 2/2009 | Lichti et al. | 123/90.17 |
| 2009/0090322 | A1 * | 4/2009 | Kokubo et al. | 123/90.17 |
| 2009/0235883 | A1 * | 9/2009 | Watanabe | 123/90.15 |
| 2011/0036319 | A1 * | 2/2011 | Kameda et al. | 123/90.17 |

* cited by examiner

*Primary Examiner* — Kenneth Bomberg
*Assistant Examiner* — Daniel Wagnitz
(74) *Attorney, Agent, or Firm* — Morgan, Lewis & Bockius LLP

(57) ABSTRACT

A continuously variable valve timing apparatus may include an end plate connected to a camshaft, a drive sprocket rotating the end plate, a first friction plate disposed to be coaxial to the end plate, a second friction plate disposed to be coaxial to the end plate, a first brake selectively braking the first friction plate, a second brake selectively braking the second friction plate, and a control gear portion which changes relative phase between the end plate and the drive sprocket according to braking of the first friction plate or the second friction plate.

16 Claims, 6 Drawing Sheets

CONTINUOUS VARIABLE VALVE TIMING APPARATUS

CROSS-REFERENCE TO RELATED APPLICATION

The present application claims priority to Korean Patent Application No. 10-2010-0057205 filed in the Korean Intellectual Property Office on Jun. 16, 2010, the entire contents of which is incorporated herein for all purposes by this reference.

BACKGROUND OF THE INVENTION

1. Field of the Invention

The present invention relates to a continuously variable valve timing apparatus. More particularly, the present invention relates to a continuously variable valve timing apparatus which may adjust the timing of the opening and closing of valves.

2. Description of Related Art

Generally, a continuously variable valve timing apparatus (CVVT or Camshaft phaser) is a device which may adjust the timing of the opening and closing of valves.

A general continuously variable valve timing apparatus, usually used in vehicle makers, i.e. a vane-type variable valve timing apparatus, needs relatively small volume and is economical.

The vane-type variable valve timing apparatus, however, uses lubrication oil of an engine, and thus, when oil pressure is low, rapid and accurate control cannot be expected.

Particularly, in idle state, in high temperature, in start condition and so on, when engine oil pressure is not sufficient, relative phase change of a camshaft cannot be obtained, and excessive exhaust gas is generated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable valve timing apparatus having advantages of adjusting the timing of the opening and closing of valves without operational oil.

In an aspect of the present invention, the continuously variable valve timing apparatus may include an end plate connected to a camshaft, a drive sprocket rotating the end plate, a first friction plate disposed to be coaxial to the end plate, a second friction plate coaxial to the end plate, a first brake selectively braking the first friction plate, a second brake selectively braking the second friction plate, and a control gear portion which changes relative phase between the end plate and the drive sprocket according to braking of the first friction plate or the second friction plate.

The first brake and the second brake may be respectively a first electromagnetic coil and a second electromagnetic coil, and selectively brake the first friction plate and the second friction plate respectively.

The apparatus may further include a first gear formed to the first friction plate, a second gear formed to the second friction plate, and a housing which may be connected to the drive sprocket and a housing gear may be formed therein, and the control gear portion may include a worm shaft rotatably coupled to the end plate, a third gear which may be formed to one end of the worm shaft and engaged with the first gear, a fourth gear which may be formed to the other end of the worm shaft and engaged with the second gear, and a worm wheel rotatably coupled to the end plate and meshed with the worm shaft and the housing gear.

The first gear may be a first driving bevel gear, the second gear may be a second driving bevel gear, the third gear may be a first driven bevel gear, and the fourth gear may be a second driven bevel gear.

The apparatus may further include a plate bearing disposed between the first friction plate and the second friction plate.

The worm shaft may be rotatably mounted to the end plate by a worm shaft case, wherein the worm shaft case and the end plate may be integrally formed, and wherein the first friction plate and the second friction plate may be respectively rotatably disposed to the worm shaft case.

A limiting stepped portion may be formed to the drive sprocket, and a limiting protrude portion may be formed to the end plate, wherein the limiting stepped portion and the limiting protrude portion may be selectively engaged each other to limit phase change between the drive sprocket and the end plate.

In another aspect of the present invention, the continuously variable valve timing apparatus may include an end plate connected to a camshaft, a drive sprocket rotating the end plate, a worm shaft rotatably coupled to the end plate, a first driven bevel gear formed to an end of the worm shaft, a second driven bevel gear formed to the other end of the worm shaft, a housing which may be connected to the drive sprocket and a housing gear may be formed therein, a worm wheel rotatably coupled to the end plate and meshed with the worm shaft and the housing gear, and a phase control portion which selectively rotates the first driven bevel gear or the second driven bevel gear to change relative phase between the end plate and the drive sprocket.

The phase control portion may include a first friction plate which may be disposed to be coaxial to the end plate, and a first driving bevel gear, engaged with the first driven bevel gear, may be formed thereto, a second friction plate which may be disposed to be coaxial to the end plate, and a second driving bevel gear, engaged with the second driven bevel gear, may be formed thereto, a first brake selectively braking the first friction plate, and a second brake selectively braking the second friction plate.

The first brake and the second brake may be respectively a first electromagnetic coil and a second electromagnetic coil, and selectively brake the first friction plate and the second friction plate respectively.

The apparatus may further include a plate bearing disposed between the first friction plate and the second friction plate.

The worm shaft may be rotatably mounted to the end plate by a worm shaft case, wherein the worm shaft case and the end plate may be integrally formed, and wherein the first friction plate and the second A friction plate may be respectively rotatably disposed to the worm shaft case. A limiting stepped portion may be formed to the drive sprocket, and a limiting protrude portion may be formed to the end plate, wherein the limiting stepped portion and the limiting protrude portion may be selectively engaged to limit phase change between the drive sprocket and the end plate.

As described above, the continuously variable valve timing apparatus according to the exemplary embodiment of the present invention may adjust the timing of the opening and closing of valves regardless operational oil pressure because the apparatus doesn't need the operational oil.

When adjustment the timing of the opening and closing of valves are not required, the continuously variable valve timing apparatus according to the exemplary embodiment of the present invention doesn't need power supplies and so on so that engine efficiency may be enhanced.

Also, the continuously variable valve timing apparatus according to the exemplary embodiment of the present invention may be manufactured with simple scheme, so that manufacturing cost may be reduced.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
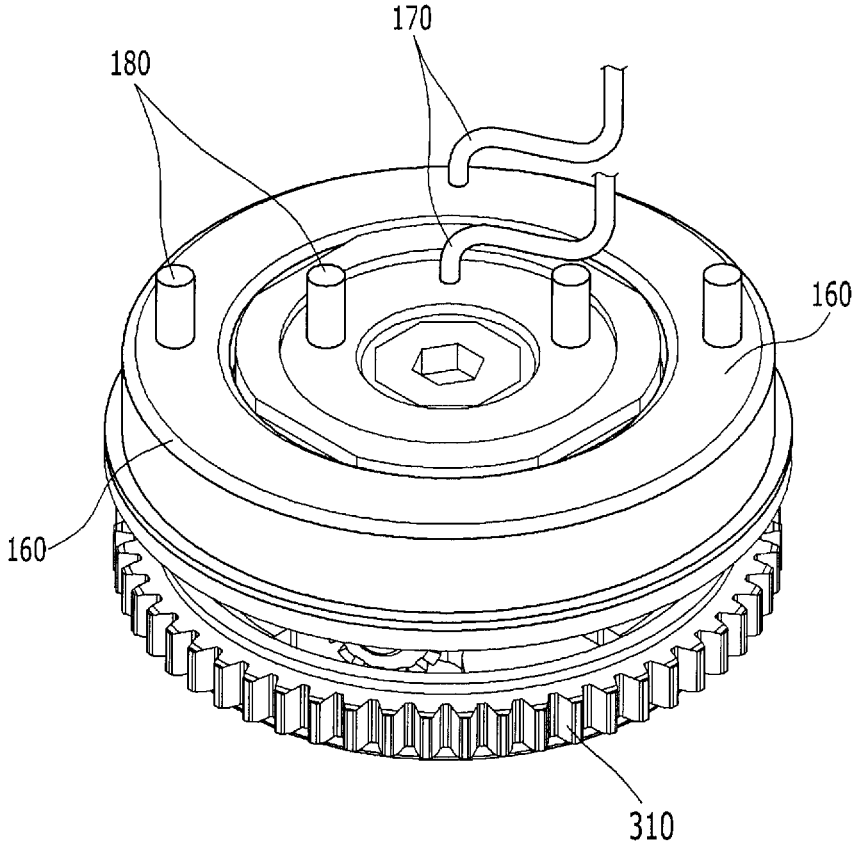
FIG. 1 is a perspective view of a continuously variable valve timing apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Figure 2:
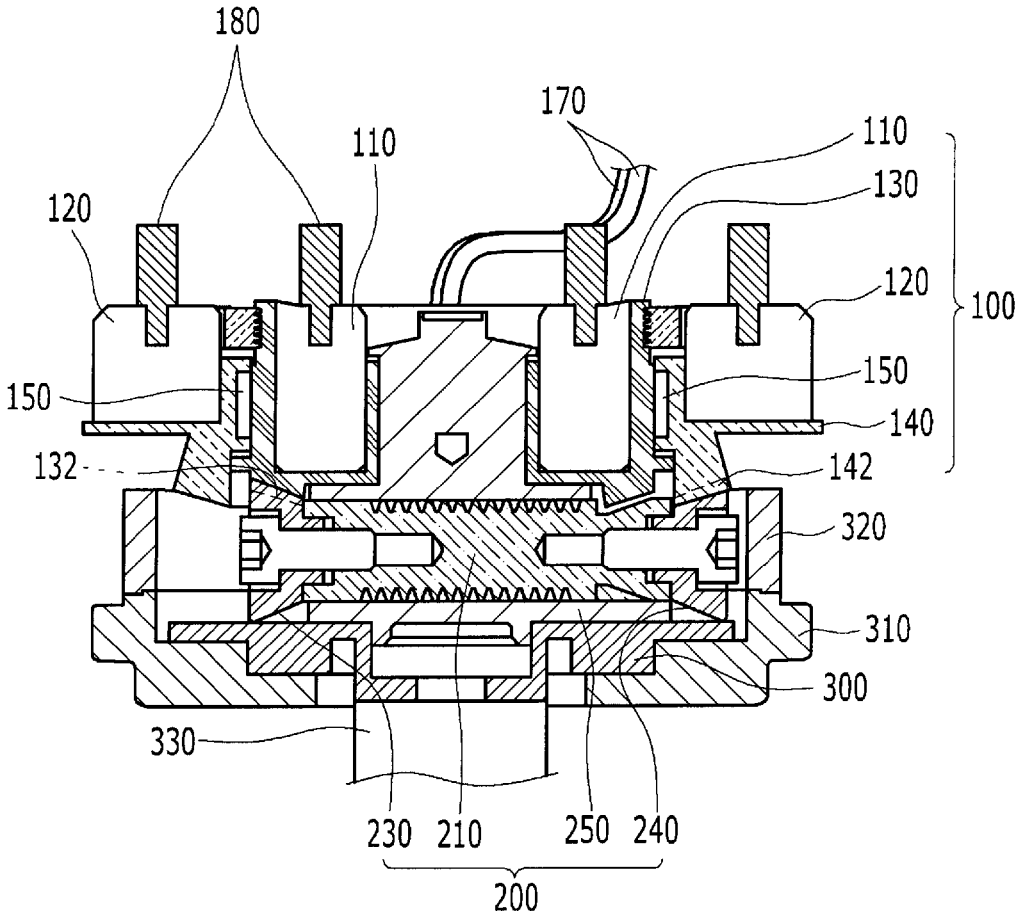
FIG. 2 is a cross-sectional view of a continuously variable valve timing apparatus according to an exemplary embodiment of the present invention.
Figure 3:
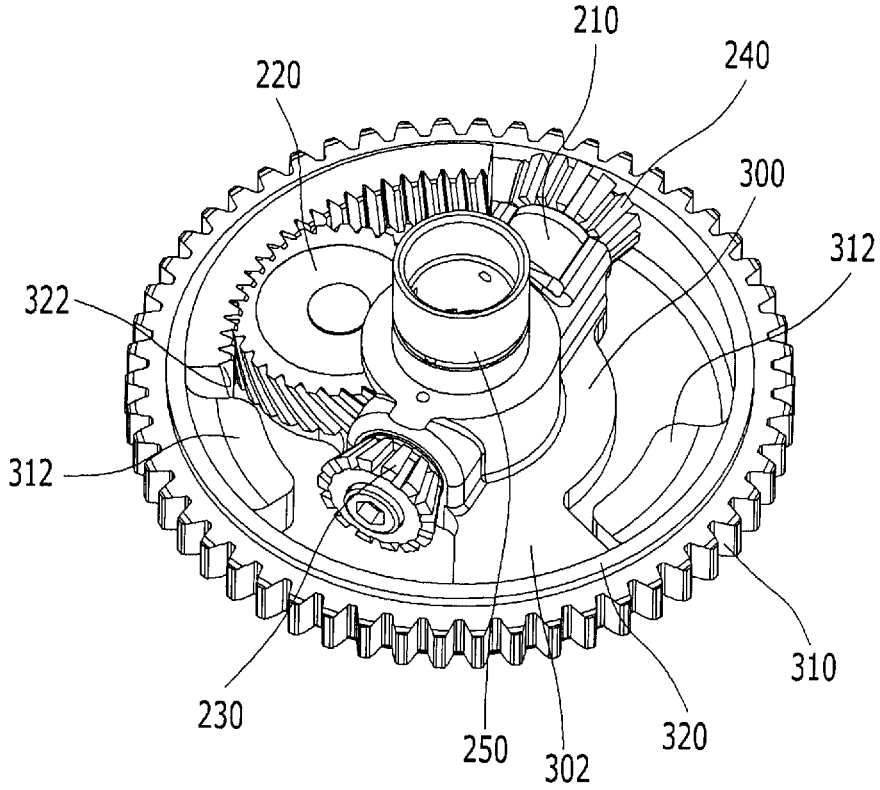
FIG. 3 to FIG. 6 are respectively partial perspective views of a continuously variable valve timing apparatus according to an exemplary embodiment of the present invention.
Figure 4:
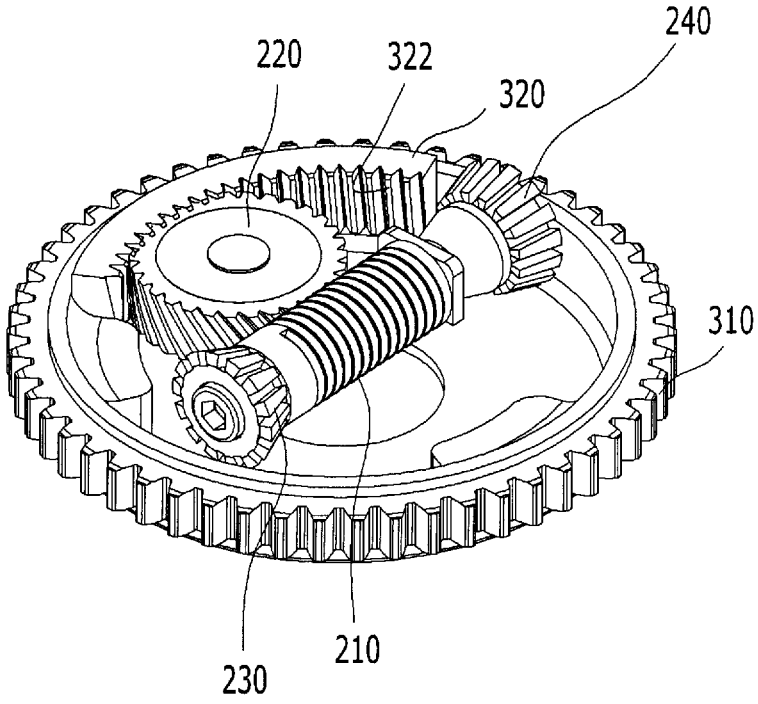

FIG. 1 is a perspective view of a continuously variable valve timing apparatus according to an exemplary embodiment of the present invention, and FIG. 2 is a cross-sectional view of a continuously variable valve timing apparatus according to an exemplary embodiment of the present invention.

FIG. 3 to FIG. 6 are respectively partial perspective views of a continuously variable valve timing apparatus according to an exemplary embodiment of the present invention.

Referring to FIG. 1 to FIG. 6, a continuously variable valve timing apparatus according to an exemplary embodiment of the present invention includes an end plate 300 connected to a camshaft 330, a drive sprocket 310 rotating the end plate 300, a first friction plate 130 disposed to be coaxial to the end plate 300, a second friction plate 140 disposed to be coaxial to the end plate 300, a first brake 110 selectively braking the first friction plate 130, a second brake 120 selectively braking the second friction plate 140 and a control gear portion 200 which changes relative phase between the end plate 300 and the drive sprocket 310 according to braking of the first friction plate and the second friction plate.

Wherein, the first friction plate 130, the second friction plate 140, the first brake 110 and the second brake 120 form a phase control portion 100.

The first brake 110 and the second brake 120 are respectively a first electromagnetic coil 110 and a second electromagnetic coil 120, and selectively brakes the first friction plate 130 and the second friction plate 140 respectively.

The first electromagnetic coil 110 and the second electromagnetic coil 120 is respectively fixed within an electromagnetic coil case 160 by an electromagnetic coil fixing bolt 180, and is supplied power from a power cable 170.

The first electromagnetic coil 110 and the second electromagnetic coil 120 are controlled by ECU (engine control unit, not shown) when retarding or advancing of opening and closing valves, and when power is selectively supplied to the first electromagnetic coil 110 and the second electromagnetic coil 120 and then the first electromagnetic coil 110 and the second electromagnetic coil 120 selectively brakes the first friction plate 130 or the second friction plate 140.

The operation of the ECU is obvious to a person skilled in the art, so detailed description will be omitted.

The continuously variable valve timing apparatus further includes a first gear 132 formed to the first friction plate 130, a second gear 142 formed to the second friction plate 140 and a housing 320 which is connected to the drive sprocket 310 and a housing gear 322 is formed therein The control gear portion 200 includes a worm shaft 210 disposed to the end plate 300, a third gear 230 which is disposed to one end of the worm shaft 210 and engaged with the first gear 132, a fourth gear 240 which is disposed to the other end of the worm shaft 210 and engaged with the second gear 142 and a worm wheel 220 engaged with the worm shaft 210 and the housing gear 322.

The first gear 132 is a first driving bevel gear 132, the second gear 142 is a second driving bevel gear 142, the third gear 230 is a first driven bevel gear 230, and the fourth gear 240 is a second driven bevel gear 240.

The apparatus further includes a plate bearing 150 disposed between the first friction plate 130 and the second friction plate 140 so that friction between the first friction plate 130 and the second friction plate 140 may be reduced.

The worm shaft 210 is mounted to the end plate 300 by a worm shaft case 250. The worm shaft case 250 and the end plate 300 may be integrally formed.

The first friction plate 130 and the second friction plate 140 are respectively rotatably disposed to the worm shaft case 250.

A limiting stepped portion 312 is formed to the drive sprocket 310, and a limiting protrude portion 302 is formed to the end plate 300, wherein the limiting stepped portion 312 and the limiting protrude portion 302 limit phase change between the drive sprocket 310 and the end plate 300.

Hereinafter, referring to the drawings, operations of the continuously variable valve timing apparatus according to an exemplary embodiment of the present invention will be described.

The drive sprocket 310 is connected with a crankshaft by a belt or a chain to rotate the camshaft 330, and a cam is disposed to the camshaft 330 to open and close an intake or an exhaust valve.

The drive sprocket 310 and the camshaft 330 rotate in self-lock condition by engaged with the housing gear 322, the worm wheel 220 and the worm shaft 210. Also, the first friction plate 130 and the second friction plate 140 engaged with the worm shaft 210 rotate also.

Figure 5:
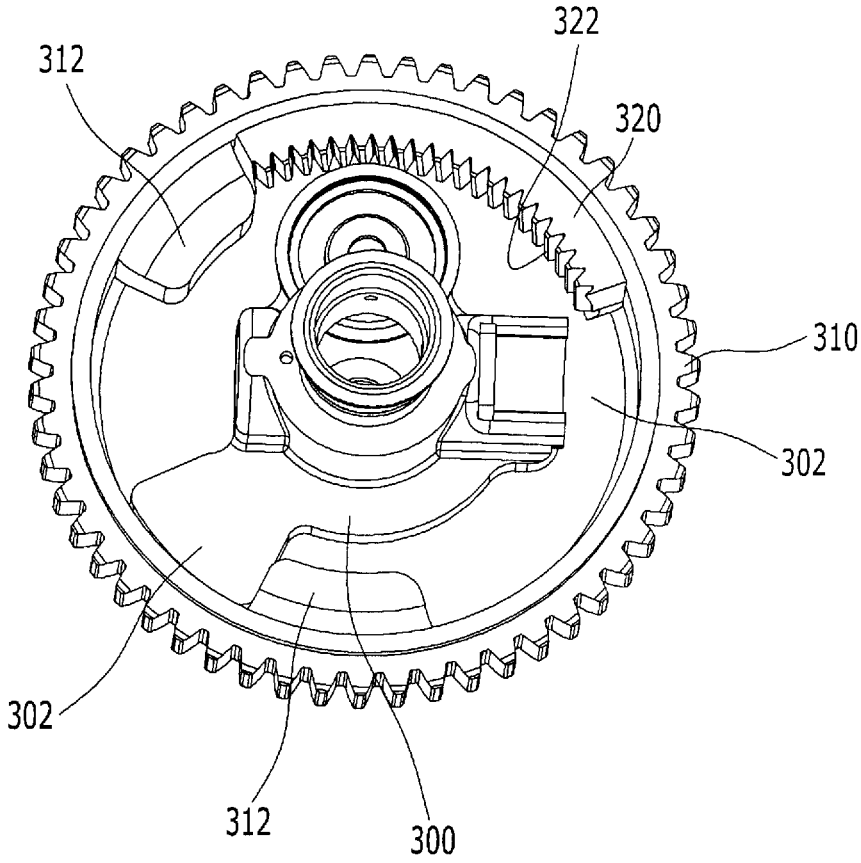
Figure 6:
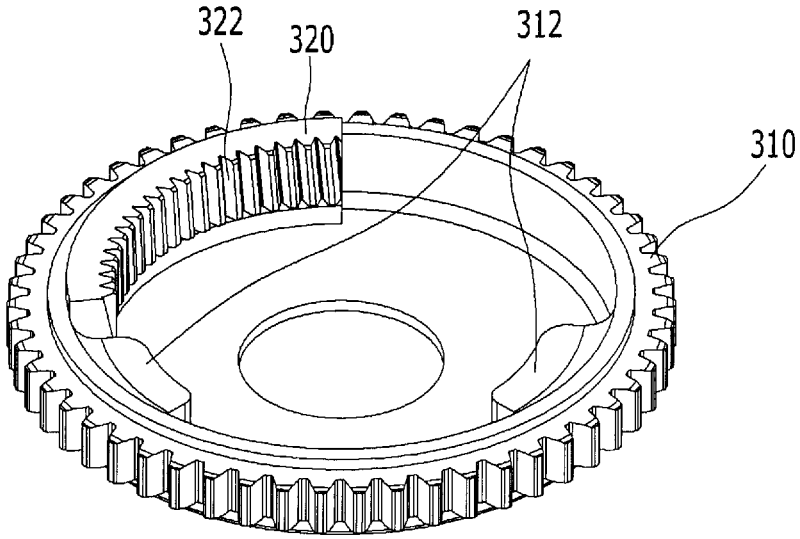

When retarding of valves are required according to engine operation condition, assuming the drive sprocket 310 as shown in FIG. 5 rotates clockwise direction, the first electromagnetic coil 110 is supplied electric power and brakes the first friction plate 130.

Then, the first driven bevel gear 230, engaged with the first driving bevel gear 132 formed to the first friction plate 130, rotates and the worm shaft 210 rotates, and the worm wheel 220 rotates in clockwise direction, so that the end plate 300 rotates anticlockwise direction relatively to the drive sprocket 310.

That is, phase of the camshaft 330 is retarded.

On the contrary, when advancing of valves are required, the second electromagnetic coil 120 is supplied electric power and brakes the second friction plate 140.

Then, the second driven bevel gear 240, engaged with the second driving bevel gear 142 formed to the second friction plate 140, rotates and the worm shaft 210 rotates, and the worm wheel 220 rotates in anti-clockwise direction, so that the end plate 300 rotates clockwise direction relatively to the drive sprocket 310.

That is, phase of the camshaft 330 is advanced.

When phase change of the camshaft 330 is not required, the worm wheel 220 and the worm shaft 210 realize self-locking condition, so that additional electric power or hydraulic pressure is not required, and thus engine efficiency may be enhanced.

As described above, the continuously variable valve timing apparatus according to the exemplary embodiment of the present invention may adjust the timing of the opening and closing of valves without operational oil, and may be manufactured with simple scheme, so that manufacturing cost may be reduced, and also, self-locking may help enhance engine efficiency.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve timing apparatus comprising:

a camshaft;

an end plate connected to the camshaft;

a drive sprocket rotating the end plate;

a first friction plat disposed to be coaxial to the end plate a second friction plate disposed to be coaxial to the end plate;

a first brake selectively braking the first friction plate;

a second brake selectively braking the second friction plate;

a control gear portion which changes relative phase between the end plate and the drive sprocket according to braking of the first friction plate or the second friction plate;

a first gear formed to the first friction plate;

a second gear formed to the second friction plate; and a housing which is connected to the drive sprocket and a housing gear is formed therein; and the control gear portion comprises:

a worm shaft rotatably coupled to the end plate;

a third gear which is formed to one end of the worm shaft and engaged with the first gear;

a fourth gear which is formed to the other end of the worm shaft and engaged with the second gear; and a worm wheel rotatably coupled to the end plate and meshed with the worm shaft and the housing gear.

2. The apparatus of claim 1, wherein the first brake and the second brake are respectively a first electromagnetic coil and a second electromagnetic coil, and selectively brake the first friction plate and the second friction plate respectively.

3. The apparatus of claim 1, wherein:

the first gear is a first driving bevel gear;

the second gear is a second driving bevel gear;

the third gear is a first driven bevel gear; and the fourth gear is a second driven bevel gear.

4. The apparatus of claim 1, further comprising a plate bearing disposed between the first friction plate and the second friction plate.

5. The apparatus of claim 1, wherein a limiting stepped portion is formed to the drive sprocket, and a limiting protrude portion is formed to the end plate, wherein the limiting stepped portion and the limiting protrude portion are selectively engaged each other to limit phase change between the drive sprocket and the end plate.

6. The apparatus of claim 1, wherein the worm shaft is rotatably mounted to the end plate by a worm shaft case.

7. The apparatus of claim 6, wherein the worm shaft case and the end plate are integrally formed.

8. The apparatus of claim 6, wherein the first friction plate and the second friction plate are respectively rotatably disposed to the worm shaft case.

9. A continuously variable valve timing apparatus comprising:

a camshaft;

an end plate connected to the camshaft;

a drive sprocket rotating the end plate;

a worm shaft rotatably coupled to the end plate;

a first driven bevel gear formed to an end of the worm shaft;

a second driven bevel gear formed to the other end of the worm shaft;

a housing which is connected to the drive sprocket and includes a housing gear is formed therein;

a worm wheel rotatably coupled to the end plate and meshed with the worm shaft and the housing gear; and a phase control portion which selectively rotates the first driven bevel gear or the second driven bevel gear to change relative phase between the end plate and the drive sprocket.

10. The apparatus of claim 9, wherein a limiting stepped portion is formed to the drive sprocket, and a limiting protrude portion is formed to the end plate, wherein the limiting stepped portion and the limiting protrude portion are selectively engaged to limit phase change between the drive sprocket and the end plate.

11. The apparatus of claim 9, wherein the phase control portion comprises:

a first friction plate which is disposed to be coaxial to the end plate, and a first driving bevel gear, engaged with the first driven bevel gear, is formed thereto;

a second friction plate which is disposed to be coaxial to the end plate, and a second driving bevel gear, engaged with the second driven bevel gear, is formed thereto;

a first brake selectively braking the first friction plate; and a second brake selectively braking the second friction plate.

12. The apparatus of claim 11, wherein the first brake and the second brake are respectively a first electromagnetic coil and a second electromagnetic coil, and selectively brake the first friction plate and the second friction plate respectively.

13. The apparatus of claim 11, further comprising a plate bearing disposed between the first friction plate and the second friction plate.

14. The apparatus of claim 9, wherein the worm shaft is rotatably mounted to the end plate by a worm shaft case.

15. The apparatus of claim 14, wherein the worm shaft case and the end plate are integrally formed.

16. The apparatus of claim 14, wherein the first friction plate and the second friction plate are respectively rotatably disposed to the worm shaft case.

* * * * *